United States Patent [19]

Daily et al.

[11] 3,974,573

[45] Aug. 17, 1976

[54] DRYER HAVING IMPROVED HEATING SYSTEM

[75] Inventors: Thomas E. Daily; Charles O. Stanford, both of Herrin, Ill.; William L. Hinners, Connersville, Ind.

[73] Assignee: Fedders Corporation, Edison, N.J.

[22] Filed: Mar. 3, 1975

[21] Appl. No.: 554,531

[52] U.S. Cl. ..... 34/48; 34/131; 34/133; 432/105

[51] Int. Cl.[2] ..... F26B 11/02

[58] Field of Search ..... 34/130, 131, 133, 48, 34/132; 432/105, 107

[56] References Cited

UNITED STATES PATENTS

| | | | |
|---|---|---|---|
| 2,830,385 | 4/1958 | Smith | 34/133 |
| 3,526,968 | 9/1970 | Triplett | 34/48 |
| 3,571,941 | 3/1971 | Garfield | 34/48 |
| 3,612,500 | 10/1971 | Cramer | 34/48 |
| 3,624,918 | 12/1971 | Heftler | 34/48 |
| 3,826,607 | 7/1974 | Kuhn | 34/133 |
| 3,852,892 | 12/1974 | Sheehan | 34/242 |
| 3,875,679 | 4/1975 | Condit | 34/131 |

*Primary Examiner*—John J. Camby
*Assistant Examiner*—Larry I. Schwartz
*Attorney, Agent, or Firm*—McAulay, Fields, Fisher & Goldstein

[57] ABSTRACT

A gas clothes dryer comprising a cabinet having a rotatable cylinder therein for receiving the clothes to be dried. A gas burner head produces hot air which is conducted, through an appropriate duct, to the rear of the cylinder. An exhaust fan exhausts the air in the cylinder through the front of the cylinder thereby causing the hot air to flow from the rear to the front of the cylinder across the clothes to be dried. The duct comprises a wall in facing relationship to the rear of the cylinder and having openings therein through which the hot air passes to enter the cylinder. A portion of the duct extends forward and surrounds a portion of the cylinder and is spaced therefrom to define an air passage therebetween. Accordingly, the exhaust fan also causes ambient air to be drawn through the air passage and into the cylinder thereby to decrease air flow about the burner head. As a result, pilot light outage is minimized and, since the burner head operates at decreased air flow, flame burn-out is eliminated.

9 Claims, 6 Drawing Figures

FIG. 1
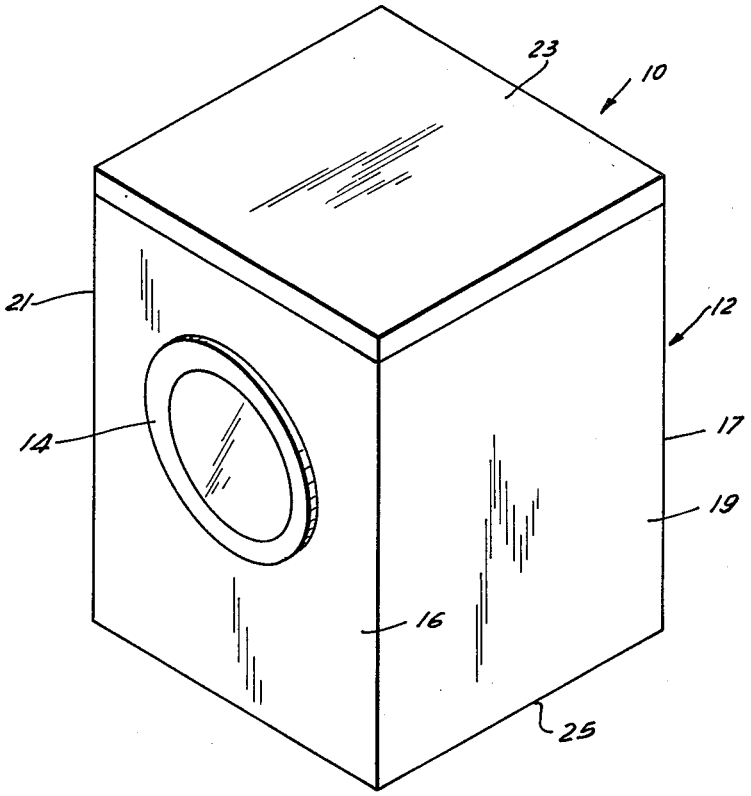
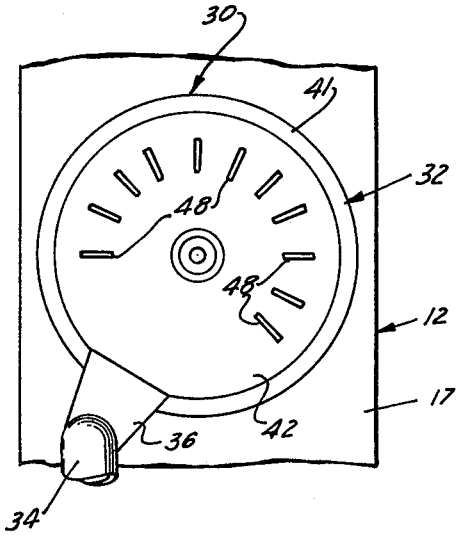
FIG. 3

FIG. 4
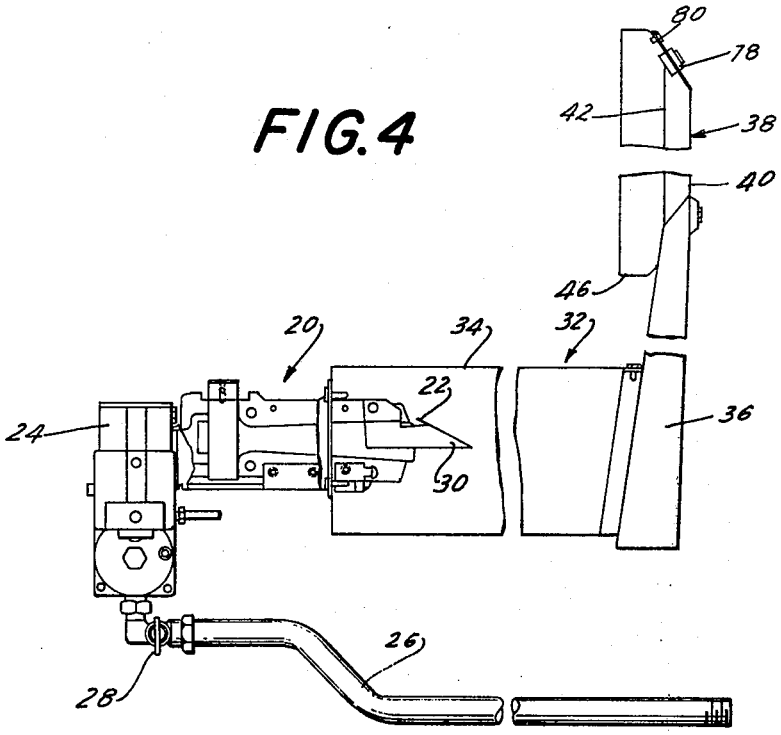
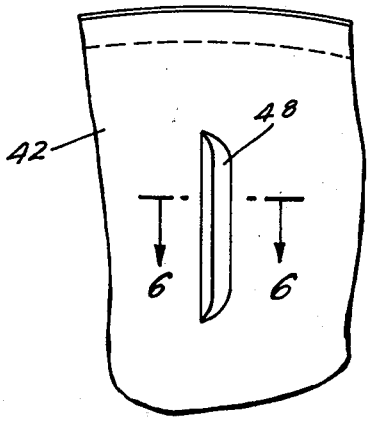
FIG. 5
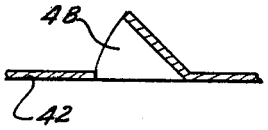
FIG. 6

DRYER HAVING IMPROVED HEATING SYSTEM

This invention relates generally to a clothes dryer and, more particularly, pertains to a gas clothes dryer having an improved heating system.

Gas heated hot air clothes dryers usually comprise a sealed heating system for drying the clothes received in the drying drum. More specifically, the gas dryers usually comprise a burner head that produces the heated air for drying. A tube surrounds the burner head to confine the flame and is in spaced relationship thereto to permit ambient air to flow past the burner head. A duct connects the tube to a hot air distributor at the rear of the drum. The distributor, which is part of the duct, includes a forwardly extending wall that surrounds the drum and is in spaced relationship thereto. In present gas dryer constructions, a seal is provided between the drum and the forwardly extending wall so that all of the heated air flows from the chamber into the drum or cylinder. A fan is positioned to cause the hot air to flow through the drum from the rear to the front thereof and, through an appropriate passage, to a vent. However, in practice, many problems have been produced by this type of construction.

For example, all the air entering the drum or cylinder must flow past the burner head. Many times, this large volume of air has caused the pilot light to blow out. Additionally, since the burner head is designed to operate at relatively high air flow, burn-outs have occurred as a result of fan stoppage and blockage. That is, if the fan stops or is blocked, the flame from the burner head has a tendency to extend outside of and around the tube surrounding the burner head. If this condition is allowed to continue even for a relatively short time, serious problems may develop.

Accordingly, an object of the present invention is to provide a gas dryer having an improved heating system.

A more specific object of this aspect of the invention is to provide a gas dryer having a heating system wherein the burner head is subject to a lesser air flow than previous constructions.

Another object of the invention is the provision of a heating system for a dryer that is reliable in operation.

A further object of the present invention resides in the novel details of construction that provide a dryer having a heating system of the type described wherein the burner head is quickly disabled upon detection of temperature above safe levels.

Accordingly, a gas dryer constructed according to the present invention comprises a cabinet having a rotatable cylinder therein for receiving the materials to be dried. A gas burner head is received within the cabinet for producing heated air and duct means provides a passage for the heated air from the gas burner head to the cylinder or drum. The duct means comprises at least a member in facing relationship to an end of the cylinder to direct the hot air into the cylinder through the end. An air passage is provided between the member and the end of the cylinder to permit ambient air to flow into the cylinder through the end. Blower means causes the heated air to flow through the cylinder so that the materials within the cylinder are dried.

Other features and advantages of the present invention will become more apparent from a consideration of the following detailed description, when taken in conjunction with the accompanying drawings, in which:

FIG. 1 is a perspective view of a dryer utilizing the heating system of the present invention;

FIG. 3 is a partial front elevational view of the hot air duct taken along the line 3—3 of FIG. 2;

FIG. 4 is a vertical section view, partially in diagrammatic form and with parts broken away in the interests of clarity, showing the gas burner head assembly of the present invention;

FIG. 5 is a detail view of a louver shown in FIG. 3; and

FIG. 6 is a sectional view taken along the line 6—6 of FIG. 5.

Figure 2:
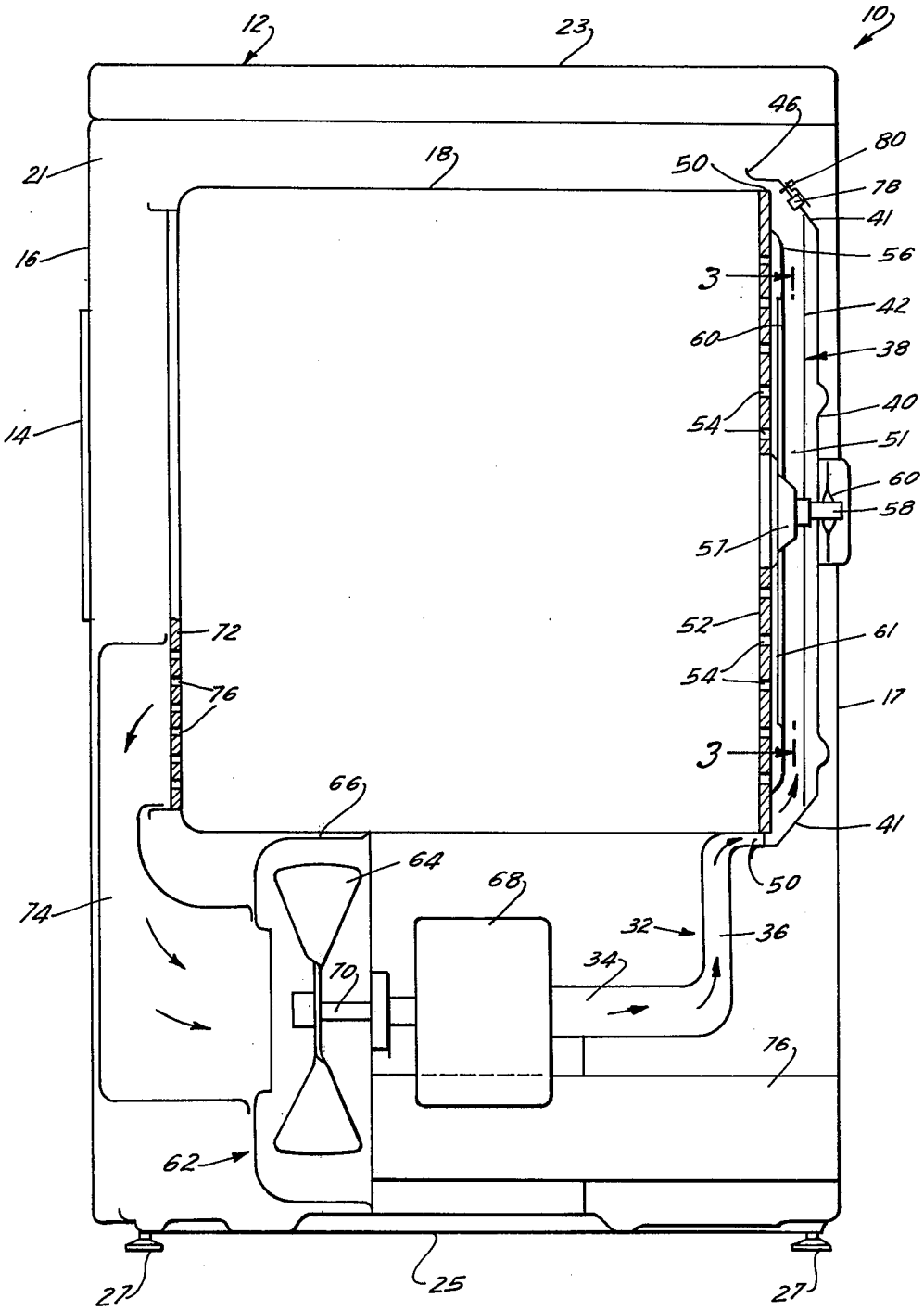
FIG. 2 is a vertical sectional view of the dryer shown in FIG. 1 to an enlarged scale, as seen looking from the side, illustrating portions of the heating system of the present invention.

Accordingly, a dryer constructed according to the present invention is designated by the reference character 10 in the FIGS. and comprises a cabinet 12. The cabinet 12 comprises a front wall 16, a rear wall 17, side walls 19 and 21, a top wall 23 and a bottom wall 25. Adjustable feet 27 (FIG. 2) may be provided in the bottom wall 25 so that the dryer may be levelled in position. A front door 14 is mounted on the front wall 16 by appropriate hinges (not shown) to provide access through the front wall to a drum or cylinder 18 rotatably mounted within the cabinet. The clothes or materials to be dried are inserted into the drum 18 through the door 14. As is conventional in dryer constructions of this type, the drum is rotated by a motor 68 (FIG. 2) while heated or hot air is forced through the drum or cylinder 18 from the rear wall to the front wall thereof. That is, the cylinder or drum 18 includes a rear wall 52 provided with perforations 54. A circular shaft support wall 57 of slightly smaller diameter than the wall 52 is connected to the outer surface of the wall and supports a shaft 58 that is received in a bearing support 60 on the rear wall 17 of the cabinet 12 to permit rotation of the drum. The shaft support wall 57 is provided with openings 61 so that heated air can enter the cylinder or drum 18 through the openings 61 and perforations 54. After the clothes or materials have been dried, they are removed through the front door 14. In accordance with the present invention, a novel heating system is provided that eliminates many of the problems which have occurred heretofore with presently used systems. Those portions of the dryer which are conventional and are not necessary for an understanding of the invention are only shown diagrammatically. If more information on these portions is desired, reference may be had to any one of the many patents illustrating such constructions.

The heating system of the present invention includes a gas burner assembly designated generally by the reference character 20. The burner assembly includes a gas burner head 22 connected to a valve assembly 24. The valve assembly is connected to a gas pipe 26 through a manually operable shut-off valve 28. The gas pipe 26 is adapted to be connected to an external supply of gas. The gas burner assembly 20 is conventional in construction and normally includes a pilot light that is adapted to ignite the gas flowing from a main orifice past a flame spreader 30 when the valve assembly 24 opens to permit gas flow through the main orifice (not shown). The valve assembly 24 is normally operated by the controls (not shown) located on the control panel of the dryer. Additionally, as noted in detail below, safety devices are included in the heating system to close the valve assembly 24 and to shut off the gas supply when an unsafe condition is detected.

A duct designated generally by the reference numeral 32 in FIGS. 3 and 4 connects the gas burner head with the rear of the drum 18 to provide a passage for the flow of the heated air from the gas burner assembly to the drum or cylinder. The duct 32 includes a conduit or tube 34 that surrounds the gas burner head 22 and is in spaced relation thereto to provide an air passage for the flow of ambient air from the interior of the cabinet 12 past the flame spreader 30 so that the air is heated. The conduit or tube 34 is connected to an enclosed upwardly extending passage 36 which, in turn, communicates with a hot air distribution chamber designated generally by the reference character 38. The chamber 38 is defined by a circular rear wall 40 and circular front wall 42 in facing relationship to the rear wall 52 of the drum. The rear wall 40 includes a portion 41 that tapers radially outwardly and forwardly, as shown in FIG. 2, and further includes a forwardly extending peripheral flange portion 46. The front wall 42, which is spaced inwardly from the end of the flange portion 46, includes circumferentially spaced radially extending louvers 48 which provide an exit for the heated air and which distributes the hot air substantially evenly over the rear wall 52 of the drum.

The louvers are shown in detail in FIGS. 5 and 6. More specifically, the louvers are formed by pushing a flap portion of the wall 42 outwardly so that the flap forms approximately a 45° angle with the plane of the wall. This construction directs the heated air toward the rear wall of the drum in a circumferential flow.

As shown in FIG. 2, the rear portion of the drum or cylinder 18 is received within the peripheral flange portion 46 and is spaced therefrom to define a circular air passage 50 therebetween. As noted below, air is caused to flow through the air passage into the space 51 between the wall 42 and the rear wall 52 of the drum. The ambient air mixes with the hot air in the space and the air mixture flows through the openings 60 and the perforations 54 in the rear wall 52 of the drum 18 into the drum per se. It is to be noted that the walls 40 and 42 are provided with appropriate apertures and supports for the shaft 58.

The heated air is caused to flow through the drum by an exhaust fan assembly illustrated diagrammatically in FIG. 2 and designated generally by the reference character 62. More specifically, the exhaust fan assembly 62 comprises a centrifugal fan 64 in a housing 66. The fan is driven by a motor 68 via a shaft 70. The fan housing inlet in connected to the lower part of the front wall 72 of the drum 18 by a conduit 74. The front wall 72 is provided with perforations 76 to permit the conduit 74 to communicate with the interior of the drum 18. A filter (not shown) is received in the conduit 74 to filter the air withdrawn from the drum to prevent lint or other materials from reaching the fan per se. The outlet of the fan housing is connected to a vent pipe 76 that is adapted to be connected to an external venting system so that the hot air can be vented at a place remote from the dryer.

In accordance with the invention, a thermostat 78 is mounted on the top of the portion 51 of the wall 40 adjacent to the opening 50 by screws 80. The thermostat controls the operation of the valve assembly 24 of the gas burner assembly 20 and is adapted to cause the valve assembly to close when the thermostat detects air temperature above a preselected temperature which indicates an unsafe condition due to a malfunction or the like.

In operation, when the dryer controls are operated to cause the dryer to execute a drying operation, the valve assembly 24 will be actuated to permit gas to flow through the main orifice of the gas burner head 22. The pilot light will ignite the flame which will then be spread within the conduit or tube 34 by the flame spreader 30. Additionally, the exhaust fan assembly 62 will be energized to draw air through the heating system. In other words, the exhaust fan assembly 62, by withdrawing the air in the drum 18 through the wall 72, will cause air to enter the tube 34 through the space provided between the tube and the burner head assembly. This air will be heated by the gas burner head and flow upwardly through the passage 36 to the hot air distribution chamber 38. Additionally, the exhaust fan will cause the hot air in the distribution chamber to flow through the louvers 48 in the front wall 42 of the chamber and into the space 51 between the front wall and the rear wall 52 of the drum 18.

In addition, a second air passage is provided through the circular air passage 50 so that ambient air will also flow into the space 51 between the rear wall 52 and the front wall 42 (which may be considered a mixing chamber) through the passage 50. In the space 51 or mixing chamber, this ambient air mixes with the hot air from the hot air distribution chamber and then flows through the openings 61 and the perforations 54 into the drum 18 where it will be exhausted through the perforations 76 in the front wall 72 of the drum. The exhausted air will flow through the exhuast fan to the vent pipe 76 and be vented to the atmosphere.

By providing the second air passage, a number of advantages are obtained by the above construction. More particularly, as a result of the air passage 50, less air passes the gas burner head 22 than would be the case if the air passage 50 were sealed, as in prior constructions. As a result, the gas burner head 22 operates at lower air flows. Hence, if the exhaust fan assembly is rendered inoperative, as would be the case if the fan 64 stops or is blocked, the flame remains within the tube or conduit 34. This is to be distinguished from the result obtained by the use of a burner head operable under high air flow conditions (as in the case where no air passage 50 is provided) wherein a burn-out effect usually takes place so that the flame extends outside and around the tube 34.

Another feature of the invention is to provide the thermostat 78 at the top of the duct adjacent the air passage. This permits unsafe conditions to be quickly detected. That is, if the fan 64 is blocked or stopped, the heated air will rise due to a chimmey effect. Since the fan is no longer operating, air is no longer being drawn through the passage 50 into the area 51 between the front wall 42 and the rear wall of the drum. Instead, the rising heated air will exit through the passage 50. Thus, the thermostat 78 will quickly heat up to disable the burner head by causing the valve assembly to close and thereby shut off the supply of gas.

Additional advantages of the present construction resides in the fact that the lesser air flow past the burner head minimizes the possibility of the pilot light being blown out.

While a preferred embodiment of the invention has been shown and described herein, it will become obvious that numerous omissions, changes and additions may be made in such embodiment without departing from the spirit and scope of the present invention.

What is claimed is:

1. A gas dryer comprising a cabinet having a rotatable cylinder therein for receiving materials to be dried; a gas burner head for producing hot air to dry the materials, duct means for providing a passage for the flow of said hot air from said gas burner head to said cylinder; said cylinder having a rear wall provided with openings therethrough for the entrance of hot air into said cylinder; said duct means comprising at least a member having a front wall in facing and spaced relationship to said cylinder rear wall and having openings for the passage of hot air therethrough, a peripheral flange on said front wall extending forwardly from said front wall and receiving the end of said cylinder therein so that said peripheral flange circumferentially surrounds said cylinder and is radially spaced therefrom to define an air passage therebetween, said cylinder rear wall and said duct means walls defining a mixing chamber therebetween that communicates with said air passage so that ambient air flowing into said chamber from said air passage mixes with said hot air; and blower means for forcing said mixed hot air and said ambient air through said cylinder.

2. A dryer as in claim 1, in which said blower means comprises an exhaust fan, and a conduit connecting said exhaust fan to the other end of said cylinder whereby said exhaust fan removes the hot air in said cylinder.

3. A dryer as in claim 1, in which said openings in said front wall comprises a plurality of circumferentially spaced radially extending louvers.

4. A dryer as in claim 3, in which said duct means further comprises a conduit surrounding said gas burner head and in spaced relationship thereto to provide an air passage about said burner head.

5. A gas dryer comprising a cabinet having a rotatable cylinder therein for receiving materials to be dried; a gas burner head for producing hot air to dry the materials, duct means for providing a passage for the flow of said hot air from said gas burner head to said cylinder; said cylinder having a rear wall provided with openings therethrough for the entrance of hot air into said cylinder; said duct means comprising at least a member having a front wall in facing and spaced relationship to said cylinder rear wall and having openings for the passage of hot air therethrough, said cylinder rear wall and said duct means wall defining a mixing chamber therebetween; an air passage communicating with said mixing chamber to provide for the flow of ambient air into said chamber to mix with said hot air; and blower means for forcing said mixed hot air and said ambient air through said cylinder, and thermostat means at the top of said member adjacent to said air passage.

6. A dryer comprising a cabinet having a rotatable cylinder therein for receiving the materials to be dried, hot air generating means for producing hot air to dry the materials, and duct means for providing a passage for the flow of said hot air from said hot air generating means to said cylinder, said duct means comprising a member in spaced relationship to one end of said cylinder to define an air passage therebetween that communicates with ambient air, blower means communicating with said cylinder to force hot air from said duct means and ambient air through said air passage into said cylinder to dry the materials therein, and thermostat means mounted on the top of said member adjacent said air passage for disabling said hot air generating means in response to the detection of temperatures above a preselected temperature.

7. A dryer as in claim 6, in which said hot air generating means comprises a gas burner head adapted to produce a flame to heat the ambient air to produce said hot air.

8. A dryer as in claim 6, in which said member comprises a forwardly extending peripheral flange spaced from said cylinder to define said air passage therebetween, said thermostat means including mounting means for mounting said thermostat on the top of said member adjacent to said peripheral flange.

9. A dryer as in claim 8, in which said peripheral flange surrounds the rear portion of the said cylinder and is spaced therefrom whereby said air passage is a circular air passage.

* * * * *